United States Patent [19]

Walsh, Jr.

[11] 4,303,239

[45] Dec. 1, 1981

[54] THIGH WEIGHTS

[76] Inventor: Richard G. Walsh, Jr., P.O. Box 1253, Boulder, Colo. 80302

[21] Appl. No.: 922,515

[22] Filed: Sep. 27, 1978

[51] Int. Cl.[3] ..... A63B 23/04

[52] U.S. Cl. ..... 272/119; 224/253; 224/222; 224/904; 2/319; 2/22

[58] Field of Search ..... 2/332, 319, 22, 24, 2/62; 272/119, 117, 96; 128/80 G; 224/222, 223, 253, 240, 267, 271, 191, DIG. 904, DIG. 907

[56] References Cited

U.S. PATENT DOCUMENTS

| | | | |
|---|---|---|---|
| D. 201,861 | 8/1965 | Cummins | 2/22 |
| 562,608 | 6/1896 | Herbelin | 2/24 |
| 725,434 | 4/1903 | Fox | 2/319 X |
| 840,745 | 1/1907 | Brainerd | 24/76 |
| 1,088,273 | 2/1914 | Golden | 2/22 |
| 1,383,062 | 6/1921 | Bascome | 2/319 |
| 1,772,922 | 8/1930 | Volz | 2/22 |
| 1,772,923 | 8/1930 | Volz | 2/22 |
| 3,401,857 | 9/1968 | Wilson | 224/253 |
| 3,427,020 | 2/1967 | Montour | 272/119 |
| 3,525,141 | 8/1970 | Smith | 272/119 |
| 3,759,510 | 9/1973 | Jackson | 272/119 |
| 4,180,261 | 12/1979 | Kolka | 272/119 |

FOREIGN PATENT DOCUMENTS

| | | | |
|---|---|---|---|
| 930754 | 7/1973 | Canada . | |
| 438487 | 12/1926 | Fed. Rep. of Germany | 224/907 |

*Primary Examiner*—Richard J. Johnson

*Attorney, Agent, or Firm*—Donald W. Margolis; H. Kenneth Johnston, II

[57] ABSTRACT

The present invention provides a totally adjustable thigh muscle exercise device. The device is totally independent of any other exercise device or structure, is constructed to provide exercise to both the flexor and extensor thigh muscles, and is adjustable as to size, weight and weight location on the thighs so that a single device may be utilized by any user at any amount of weight and for any type of thigh exercise. The device includes a belt, which may be adjusted to any user's waist size and weights suspended from the belt for location at the front of the user's thighs. In preferred embodiments, the location of the weights along the front of the device may be adjusted to accommodate the individual user's needs and the amount of weight may be easily varied. In preferred embodiments, the space between the belt and the weights may also be adjusted to further accommodate the user or the particular exercise being practiced.

6 Claims, 9 Drawing Figures

THIGH WEIGHTS

To initiate this discussion, a brief definition of the invention is in order. I have invented an exercise device named thigh weights. As their name indicates, these are exercise weights worn directly over the thighs of the user. They are supported by a belt securing around the waist of the user, and by straps securing around the thighs. Such a definition will suffice for now; naturally, a more detailed discussion will occur within the construction discussion of this application.

The thigh weights relate to new and useful improvements in exercise weights that are worn on the body. The prior art in the field includes ankle weights, wrist weights, weighted belts, weighted vests, and even head weights. With the exception of this final item, for which specific neck exercises are prescribed, all of the mentioned weights may be worn while performing common, conventional exercises such as jogging, hiking, playing tennis, riding a bicycle, and so forth. Indeed, the idea behind the practice of exercising with weights worn on the body is to enable the wearer to practice their favorite sport or activity in a relatively unhindered manner, with the extra resistance strengthening and toning their muscles simultaneously.

The thigh weights utilize this same principle, and yet they exercise different muscle groups in an unprecedented manner. They work the flexor muscle group of the upper thighs, or those muscles which bend the upper thighs. They also concurrently work the extensor muscle group of the thighs, or those muscles which straighten them. Additionally, this muscle group activity is performed in either leg independently, or while one leg works the flexors the other works the extensors.

Such simultaneous muscle group work is accomplished when an individual is running or walking while wearing the thigh weights. With each stride or step, the foot must leave the ground. As the foot comes up, the leg to which it is attached must bend, at least in the conventional method of running or walking. It is this bending of the leg which causes the raising of the foot, and the bending is caused by thigh flexor muscle activity. Consequently, each stride or step, i.e. each raising of the foot, works the flexor muscles of the thigh. The overloading of these muscles by placing the thigh weights on them serves to give them additional work whenever that foot comes up off the ground.

Yet the flexor muscle group action is only half of the running or walking motion. For as an individual is bringing his foot up off the ground by bending his leg, he is simultaneously straightening his other leg. In other words, while one leg is off the ground, and swinging through the air, the other leg is firmly planted on the ground, serving as a base or support from which the bending or swinging motion is launched. (In running, by definition both legs are off the ground simultaneously for a brief instant, yet the same principle holds for practical purposes.) So as one leg bends or flexes, the other leg straightens or extends. And it must be kept in mind that the thigh weights offer additional resistance to the extensor muscle group. For while one leg is bending and overcoming the thigh weight resistance on it, the straightening leg must also overcome the extra resistance on it. The thigh weights attach just below the waist of the user, and any extra weight carried here (or in fact in many other places on the body) will give additional work to the extensor muscle group. In fact, in an activity such as jumping off of both legs, where the extensor muscles are used simultaneously (little flexor activity since the feet do not leave the ground as the legs bend), the extra weight of the thigh weights will in its entirety be used to overload these extensor muscles. Quite simply, the body is jumping with x extra pounds attached to it.

Of the prior art in the field, the closest item to the thigh weights are the ankle weights. However, not only are some different muscle groups worked, as previously stated, but the same muscle groups are worked in a distinguishable manner.

To see for himself the differences between thigh weights and ankle weights one may make his own brief test as follows. Using a heavy shoe or boot in lieu of ankle weights, or else having someone place pressure on your foot, (the ankle weights themselves may of course be used if available), attempt to straighten your knee while you are seated. You will feel a working of your muscles just above the knee. Next, secure a pair of blue jeans or work pants with good front pockets, and place a small barbell plate or other similarly sized and weighted object in the front pockets. Then perform the same test of straightening your knee while you are seated. You will feel no such extra stress above the knee. Consequently, the ankle weights work those extensor muscles above the knee while the foot is moving, or off the ground. The thigh weights do not work this muscle group in this manner.

As such, all that I have stated thus far is that the ankle weights work a particular muscle group that the thigh weights do not while performing a single exercise. Such can hardly be said to be evidence as to the beneficial uniqueness of the thigh weights when compared to the ankle weights. Therefore, a few more comparative tests to show the isolated differences in how the two devices work the muscles, and an analysis of the walking running motion to integrate such differences, are in order.

One may also raise his leg and bend his knee while wearing the simulated ankle weight object. A muscle stress in the flexor muscle group of the upper thigh should be experienced. Then, with the leg raised, straighten the knee. You will again feel the extensor muscles above the knee go to work, with some muscle tension remaining on the upper thigh flexor muscles, necessary to keep the leg raised. So it can be said that the ankle weights also work both the flexor and extensor muscles of the legs.

Be this the case, it is logical to question the differences between the two units, other than that which has thus far been stated as to muscles the ankle weights work and thigh weights do not. Such shall now be proceeded with.

The thigh weights work the flexor muscles much more than do the ankle weights. This is true because, first of all, they are heavier than most ankle weights being used today. The author has built thigh weight units of varying capacities; one unit holds a maximum of six (6) pounds per leg, while another holds ten (10) pounds. In fact, an earlier rough thigh weight model held eighteen (18) pounds of weight over each thigh, such model being worn by the author while running on an experimental basis.

By contrast, the vast majority of ankle weights in use weigh two and one half (2½) or at the most three (3) pounds. While it is true that ankle weights are available in heavier models, such are awkward to run with and seldom used. In any event, the heaviest ankle weights possible are not as heavy as the heaviest thigh weights. Quite simply, there is a larger area around the thighs than around the ankles, and room for more weight resultingly.

The other reason that thigh weights work the flexor muscles more than the ankle weights do is because they do not work the muscles below the knee as do ankle weights. The reasoning behind this is that when the foot is raised off the ground and the knee bent, if the foot is moved in other than a strictly vertical position, as is almost always the case, the muscles above the knee must come into play. In other words, when the foot raises and swings freely with an ankle weight on it, such as in the regular running motion, the extensor muscles above the knee are worked. When this muscle group is so activated, part of the load is assumed by it, and thus less of the load by the flexor muscle group.

In thigh weight movement, such a motion of the foot in an other than vertical direction does not affect those muscles over the knee because there is no weight on the foot. All the weight is directly over the flexor muscle group, bringing only the flexor muscles (during bending and swinging of the leg) into play. There is simply no resistance elsewhere to bring other muscle groups into play and detract from flexor muscle group activity.

As stated earlier, the thigh weights work both the flexor and the extensor muscle groups, as do the ankle weights. However, in addition to working the flexor muscles more fully, the thigh weights work the extensor muscles more fully as well. They also work the flexor and extensor muscles in a unique combination, one different from the method in which the ankle weights do. The following paragraphs shall expound upon these statements.

Let us compare how the thigh weights work the extensor muscles more fully than do the ankle weights, and then integrate this superiority of extensor muscle activity into the unique manner in which thigh weights work both muscle groups when compared to the way in which ankle weights do.

First of all, thigh weights work the extensor muscles more severely because, as discussed earlier, they are by and large substantially heavier, both those in current use and in potential. It should be kept in mind that the extensor muscles of the legs are perhaps the strongest muscle group of the body, and a resistance substantially in excess of that of the typical ankle weights may be used readily.

In addition to being heavier, thigh weights also work the extensor muscles more because of their location. To demonstrate this, another brief test is called for. Simulating ankle weight and thigh weight units as suggested earlier, merely bend and straighten the legs. Perform this movement first in the heavy shoes or boots for the ankle weight simulation, and then with the objects in the pockets for the thigh weight simulation. (For best results, have your "thigh weights" at least twice as heavy as your "ankle weights" if at all possible, duplicating the weight ratio of the actual units.) You should observe how the extensor muscles are worked when wearing the thigh weight simulated device. This is because they are above the knee and connected to the muscles whch are actually moving, the thighs. Since the ankle weights attach below the knee, they are not fastened to or above any muscles which move when performing this simple exercise, for it is obvious that the feet do not move while exercising as directed.

There exists the possibility that one might not have been able to entertain an appreciable difference when performing the exercise procedures previously outlined. This is to say that the extensor muscle group may not have been felt to have been taxed more during the wearing of the thigh weight simulated unit than during the wearing of the ankle weight simulated unit. If this is the case, the author invites the reader to imagine doing the same exercise with his feet cast in concrete blocks in place of the ankle weights. Again, there is little or no extra resistance to the extensor muscle group, as no load is on or above them and the legs straighten against no opposing force. Then imagine performing the same exercise with the same concrete blocks placed directly over the thighs, attached from a belt and simulating, of course, the thigh weights. Here there is a severe resistance on the extensor muscles of the legs, as the weight of the blocks must be overcome for the legs to straighten.

On further discussion of how thigh weights work the extensor muscles more fully, a comparison of two well known weight training exercises will be beneficial. These exercises are the thigh extension and the squat.

The common thigh extension exercise is done very similarly to the initial ankle weight test that was performed. The difference is that a special apparatus, consisting of a table with a swinging weighted bar attached to it, is used. The subject sits on the table with his knees bent and, placing his feet under the weighted bar, moves it up and out by straightening his legs. It is not difficult to see how this thigh extension exercise movement simulates a leg straightening with an ankle weight attached to it, which is of course the extensor muscle activity that takes place with ankle weights on.

The squat exercise is merely the bending and straightening of the legs against a weighted resistance. The last exercise test performed, that of bending and straightening the legs with first "ankle weights" on and then "thigh weights," was actually a squat exercise. This exercise is usually done, however, by placing a heavily weighted barbell over the shoulders and then bending and straightening the legs. (The muscle stress takes place, of course, during the straightening, or extending, action.)

It can be seen that the squat exercise simulates the extensor activity that takes place when extending the legs while wearing thigh weights. Indeed, when the user straightens the leg with the thigh weights on, he is simulating the straightening action that occurs when squatting, and vice versa. It is easy to recall the straightening of the legs with the concrete block "thigh weights" on, and to imagine the great stress they would place on the extensor muscles.

The only real difference between extending the legs under a barbell and extending them with thigh weights secured is that only one leg at a time extends while walking or running with the thigh weights. Squats, on the other hand, are generally done with both legs at once, working both groups of extensors concurrently.

It has thus far been shown that thigh extensions simulate ankle weight extensor activity, and squats simulate thigh weight extensor activity. With this in mind, consider that the vast majority of individuals are able to squat with far more weight than they can extend with their thighs. The author has not only found this to be true from observing weight trainees over many years in various gymnasiums, but himself uses approximately three (3) times as much weight when squatting as when performing thigh extensions. The conclusion that may then be reached is that squatting works not only different muscle fibers within the extensor muscle group, but, since substantially more weight is used, it works more muscle fibers than does thigh extending. It follows that thigh weight extension exercise, simulating squatting, works different muscle fibers and more muscle fibers than does ankle weight extension exercise, which simulates thigh extensions. It is crystal clear that the thigh weights work the extensor muscles of the legs in a manner totally different from the way in which the ankle weights work the same general muscle group.

In comparing the thigh weights and ankle weights further, a very important point is to be considered. The ankle weights work the extensors (and flexors) only when the foot is off the ground, and the leg is straightening against the load of the ankle weight. By contrast, the thigh weights work the extensor muscles only when the foot is on the ground, and the leg is straightening against their weight. (They also work, as was previously discussed, the extensors when the foot is off the ground.)

In a running or walking motion, while one foot is off the ground, the other is, except for a very brief instant when running, on the ground. When ankle weights are worn, only one leg at a time receives resistance, be it to the flexor or extensor muscle groups. The leg that is off the ground is the leg that gets all the resistance; the flexor muscles are worked as the foot and knee go up initially, and the extensor muscles just above the knee come into play as the foot swings forward, often while still going up.

With thigh weights, both legs are receiving resistance simultaneously. The leg off the ground is flexing against the weight over its thigh, at least while it is moving upward, and the leg in contact with the ground is extending against the weight over it. Or, more simply put, with thigh weights the flexors of one leg work while do the extensors of the other leg. Such action specific to thigh weights, as compared to ankle weights, is yet another manner in which the thigh weights work the muscles differently.

Of the remaining prior art in the field, only weighted belts and weighted vests are pertinent. The previously mentioned wrist weights and head weights do not apply; it is obvious that neither of them work the legs in any manner to speak of.

Weighted belts and weighted vests are very similar in function. They both overload the trunk of the body for various physical activities. The only major differences between the two are that weighted vests slip over the shoulders, thereby putting some stress on the trapezius dorsi and deltoid muscle groups, and the weighted vests may carry their weight a little higher and are often heavier. However, certain of the weighted vests carry their weight at the bottom of the unit, right at the abdominal region and very close to where the weighted belt is worn. Also, the weighted vests range from ten (10) to fifty (50) pounds in weight, with most of them at twenty (20)to thirty (30) pounds, and the weighted belts go from eight (8) to eighteen (18) pounds, with those in the eight (8) to ten (10) pound range most common. So though weighted vests are usually heavier than weighted belts, it is not inconceivable for the belts to at times be nearly as heavy, just as heavy, or even heavier.

Like thigh weights, weighted vests and belts work the extensor muscles of the legs. However, unlike thigh weights, they do not work the flexor muscles of the legs to any extent. This can be witnessed as follows. Place an object weighing around fifteen (15), twenty (20) or thirty (30) pounds on the shoulders, or even secure it around the waist if possible. (Use a bag of dog food or dry cement mix, or even a small child, or an exercise bar if available.) Then perform the squat exercise against this weight, i.e. merely bend the legs and come back up against it. Undoubtedly a stress on the extensor muscle will be felt when straightening the legs. Next, utilizing the same resistance, and perhaps grabbing onto something sturdy for balance, flex the thighs. You will feel little if any resistance in your flexor muscle group area as your knee and foot are brought up off the ground.

The author must admit that the thigh weights do not stress the extensor muscles as severely as those weighted vests and weighted belts which are heavier. However, few individuals use such weight to run in, as this very strenuous exercise is only for the fittest. Moreover, the weighted vests and belts do not load the flexor muscles, as discussed. Again, it is this combination flexor and extensor muscular activity which differentiates the thigh weights from weighted vests and belts, and this uniqueness consequently grants them a superiority in their own right.

The general objects of the invention are to offer such a thigh weight exercise device which is of simple construction and readily and economically manufactured on a mass production basis; is tough, sturdy, durable and therefore capable of a lengthy life of service at severe usage; it is portable and relatively small, thus easily moved about and taking up little storage space, is of attractive colors and an esthetically pleasing design for the enjoyment of the user; is adaptable to numerous different exercises, affording the user optimal exercise versatility; is easily and simply slipped onto and off the body of the user, therefore saving time in the beginning and ceasing of exercise with the device; is quickly and simply adjustable in the amount of weight it carries to exercise, and thus adaptable to users of varying strength and fitness levels; is also quickly and simply adjustable, through its belt, to users of varying waist and hip sizes, and is also quickly and simply adjustable, through its thigh straps, to users of varying thigh sizes.

A more specific objective of the invention is to provide such a thigh weight exercise device which is readily integrated with other exercise devices, namely those described heretofore as being of the prior art in the field, for the purpose of exercise thereof.

A further objective of the invention is to provide an exercise device as described which offers the user a unique manner and method of exercise which had been hitherto unavailable through any such exercise device.

Another objective of the invention is to offer the user an exercise device which may be manipulated along the waist, hips, and thigh of the user for various exercises not involving the act of running, such as raising the legs sidewise, one leg at a time, and working otherwise neglected muscle groups in the process.

These objectives and other objectives of the invention which will in part be obvious reside in the construction details and will in part appear hereinafter.

The invention hence comprises the detailed properties of construction, consolidation of elements or materials, and array of parts, these being exemplified in the description of the construction hereinafter set forth, and the capacity of the invention will be specified in the claims.

For the purpose of a greater understanding of the objects and disposition of the invention, reference may be had to the following detailed drawings and description, in which each respective part of the invention, as followed with a corresponding number, is then referred to by the same number in any or all of the drawings which follow, and in which.

Figure 5:
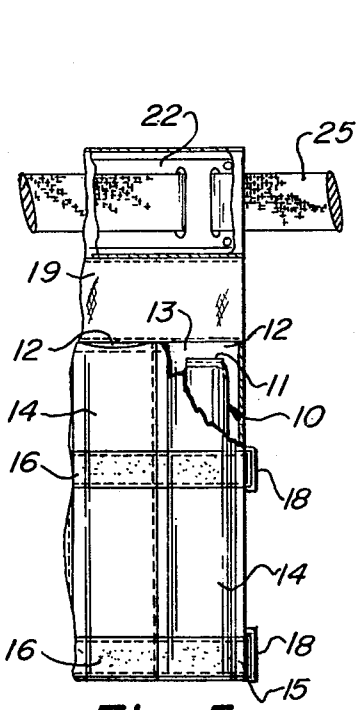
FIG. 5 is a fragmentary view of the left side of the thigh weights.
Figure 3:
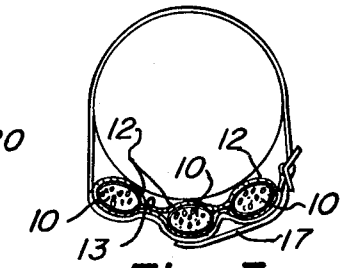
FIG. 3 is a section taken through the thigh weights left side.
Figure 4:
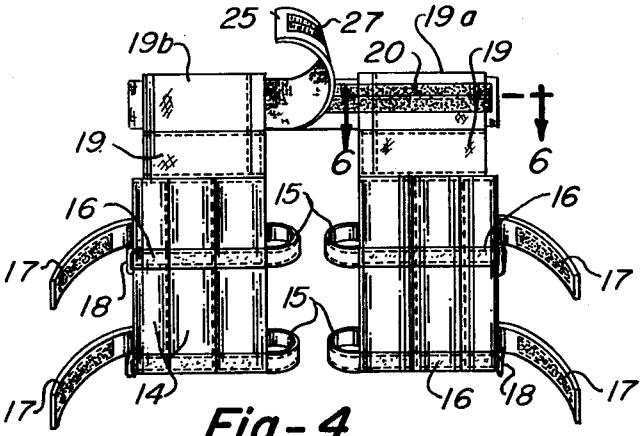
FIG. 4 is a front elevation showing the main components of the thigh weights.
Figure 2:
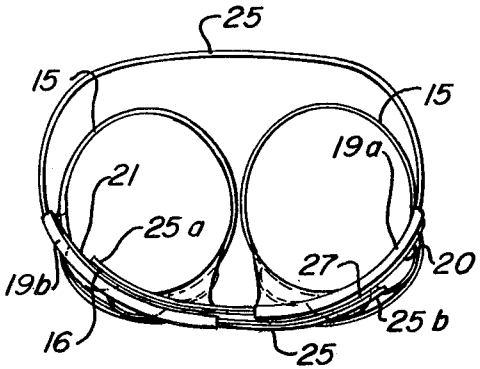
FIG. 2 is a top plan view, section 2—2 taken through FIG. 1.
Figure 1:
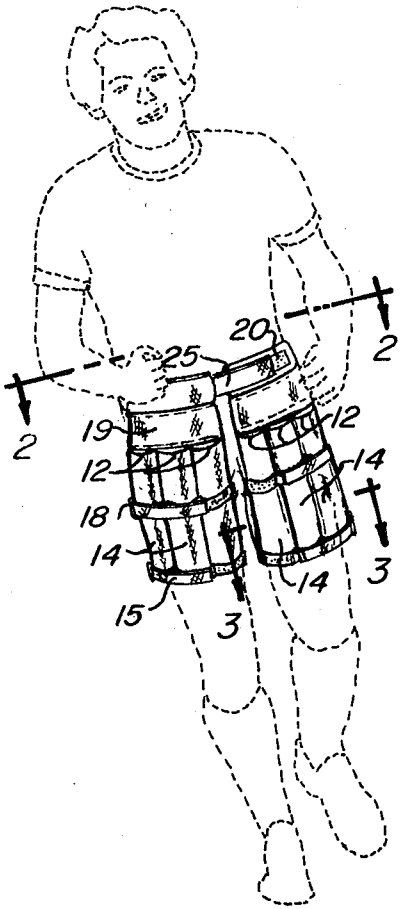
FIG. 1 is a view of a person wearing the thigh weights in an exercise position.
Figure 6:
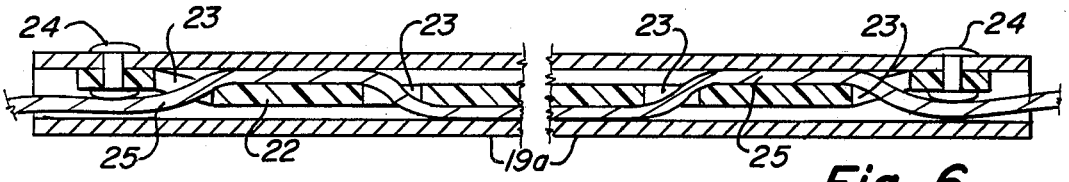
FIG. 6 is a partial section view of the support belt and associated parts taken from FIG. 4.
Figure 7:
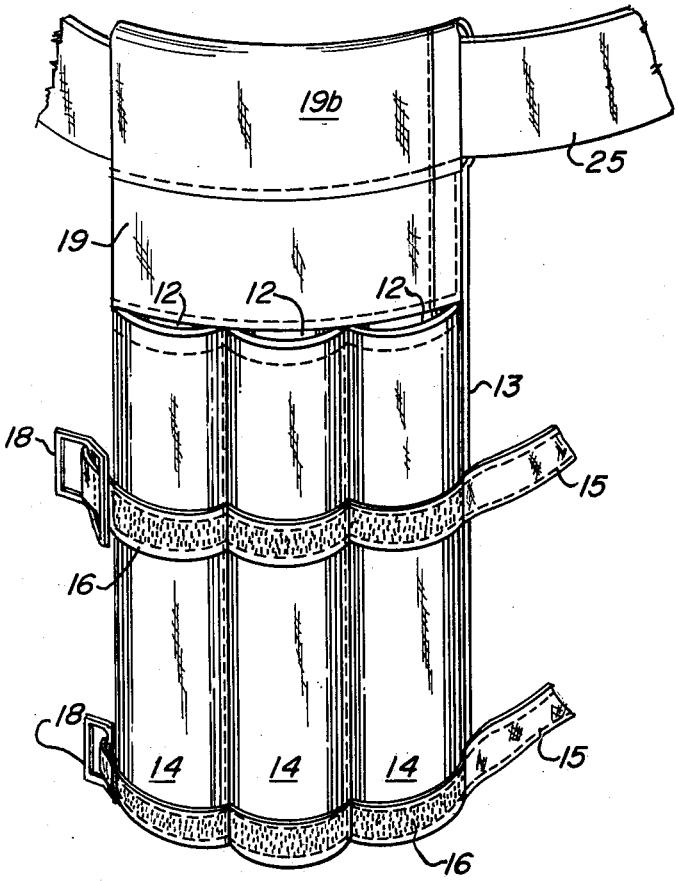
FIG. 7 is a fragmentary perspective view of the right side of the thigh weights.
Figure 8:
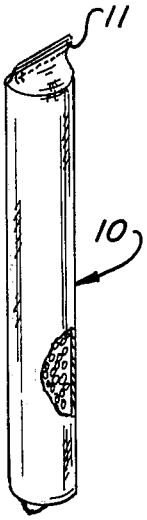
FIG. 8 is a perspective view of the tubes.
Figure 9:
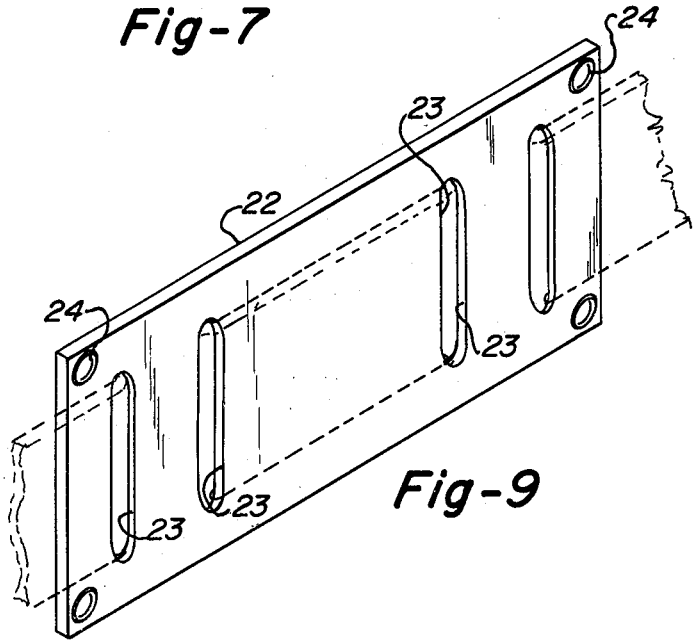
FIG. 9 is an isometric view of the d pad showing the slits and the interweaving through them of the support belt.

The tubes 10 consist of a suitable material, such as canvas or vinyl covered nylon, filled with weighted manner such as lead shot or sand, and sewn or fastened shut for the securement of such weighted matter. It is the tubes 10 which afford the device resistance for the purpose of exercise.

The tabs 11 consist of the same material, and are in effect extensions of the tubes 10. It is the purpose of the tabs to offer an easily and readily accessible method for manually adhering to the tubes 10 when inserting them into and out of the pockets 12.

The pockets 12 consist of the same material, and the tubes 10 are insertable into and removable from the pockets 12, such action offering variable exercise resistance to the user. The pockets 12 are secured onto the bases 13 of the unit.

The bases 13 are those pieces, of the same material, onto which the pockets 12 are fastened. Such bases 13 carrying the pockets 12 which in turn hold the weighted tubes 10 secured directly over the front part of the thighs of the user. The conglomerations of the bases 13, pockets 12, and tubes 10 are called the weight units proper 14.

The straps 15 composed of a suitable webbing material, are fastened onto the lower parts of each of the pockets 12, and then wrap around the thighs of the user and fasten back onto the pockets 12, i.e., or in effect onto themselves, at their other ends. The straps 15 aid in adhering the weight units proper 14 to the thighs of the user.

The male strap fasteners 16 are secured over part of the straps 14 which fasten to the pockets 12, and are one part of the strap fastening process.

The female strap fasteners 17 are secured to the loose parts of the straps 15, or those ends which fasten back onto the pockets 12, through manipulation, and are the other part of the strap fastening process.

The combination of the afore mentioned male strap fasteners 16 and female strap fasteners 17 bond the straps 15 back onto the pockets 12, i.e. onto themselves, utilizing a friction or adhesive fastening method.

The strap friction buckles 18 are fastened onto each of the respective outside, or short side, ends of the straps 15, and are for the purpose of securing the integrity of the function of the straps 15, and therefore adhering the weight units proper 14 to the thighs of the user.

The flaps 19 are the top part of the bases 13 which fold over and fasten back onto themselves. Such folds then form passages through which the support belt 25, carrying the d-pads 22, passes. In turn, these two units are secured by the flaps 19.

The outside flap-to-support-belt fastener 20 is that piece of fastening material secured onto the outside of one of the flaps 19*a*. It secures part of the support belt 25 to this flap 14 and 19*a*, combining with the inside support belt fastener 27 to do so.

The underside flap-to-support-belt fastener 21 is that piece of fastening material secured onto the underside of the other flap 14*b* and 19*b* or the side adjacent to the body of the user. It secures part of the support belt 25 to this flap 19*b* combining with the outside support belt fastener 26 to do so.

The d-pads 22 slip over the support belt 25, and are in turn encased by the flaps 19. They are composed of a rectangular plastic or other material, approximately the width of the support belt and approximately the length of the flaps, and containing four (4) slits 23 through which the support belt 25 passes. The d-pads 22 serve a twofold purpose. They add support and rigidity to the support belt 25 assuming some of the load of the weight units proper 14 so the support belt 25 will be less likely to buckle under the load. They also adjust the weight units proper 14 horizontally along the support belt 25, for as the d-pads 22 move horizontally so do the flaps 19 which encase them, and consequently the weight units proper 14. Such adjustment accommodates users of varying waist and hip girths, and also allows for different positions of the weight units proper 14 for different exercises.

The rivets 24 fasten the flaps 19 to the d-pads 22 and prevent the movement of the flaps 19 without the corresponding movement of the d-pads 22. This securement gives stability to the location of the weight units proper 14 on the support belt 25, for mainly by the intentional manual moving of the d-pads 22 will the weight units proper 14 change their horizontal location on the support belt 25 vigorous exercise nonwithstanding.

The support belt 25, which is comprised of a tough, durable, relatively thick material, carries the d-pads 22 which are encased in the flaps 19, and in turn carries the weight units proper 14. The support belt 25 is adjustable for various waist sizes.

The outside support belt fastener 26 is that piece of fastening material which is secured to the outside of an end of the support belt 25*a*, and is one part of the fastening process which secures this end of the support belt 25*a* to the other end of the support b, and also secures this end of the support belt 25*a* to the underside flap-to-support belt fastener 21, and consequently to the flap 19*b* in doing so, aiding in keeping the weight units proper 14 from falling down the thighs of the user in the process.

The inside support belt fastener 27 is that piece of fastening material secured to part of the inside (side adjacent to user) of the opposite end or part of the support belt 25*b* and is the other part of the support belt fastening process which secures this end of the support belt 25*b* to the other end of the support belt 25*a* and also secures this end of the support belt 25*b* to the outside flap-to-support-belt fastener 20 and consequently to the flap 19*a* in so doing, aiding in keeping the weight units proper 14 from falling down the thighs of the user in the process.

In a modified embodiment of the invention for which drawings are not shown, there are vertical adjustment straps in place of the aforementioned flaps. These consist of, on each side of the units, two (2) lower vertical adjustment straps fastened onto the upper extremities of the pockets of the weight units, and two (2) upper vertical adjustment straps, sewn or fastened onto the d-pad above them, or, by means of forming a loop, secured over the support belt. Each of these lower vertical adjustment straps then secure to a respective upper vertical adjustment strap by means of male and female velcro material fastening methods, such velcro mateial sewn onto them. (Such securement may take place likewise by the use of a buckle, clip, etc., in place of the velcro material.) The fastenings are ajustable to move the weight units up and down the thighs of the user, adapting to variations in leg lengths and creating different absolute exercise resistances in the process.

The invention having been described heretofore, what I claim to be new and desire to secure by Letters Patent is:

1. An adjustable device for use in exercising the flexor and extensor thigh muscles of an user, said device comprising in combination: a flexible belt in the form of a strip of material having a first end and a second end, said belt designed for attachment around and removal from a user's waist or hips; adjustable belt attachment means for attaching said belt around a user's waist or hips, said attachment means associated with said first and second ends of said belts, said attachment means designed to vary the circumference of said belt to securely encircle the waist or hips of the user; first and second adjustable pads, said pads slidably secured to said belt for adjustment along the length of said belt, said pads being comprised of material which is relatively more rigid than said flexible belt; first and second weight support bases, each of said bases including an attachment portion and a body portion, the attachment portion of said first weight support base secured to said first pad and the attachment portion of said second weight support secured to said second pad, said bases being secured to said pads in such a manner that movement or adjustment of either of said pads along the length of said belt allows and results in the concurrent movement or adjustment of the attached base, said attachment portion of each said support base being attached to its associated pad by a flap, said flap being attached to said base and folded over and around a pad, and fastened back onto itself; and means for securing adjustable amounts of weight to each said support base, said means for securing adjustable amounts of weight to each support base including at least one pocket into which weights may be inserted and secured.

2. The device of claim 1 wherein each support base carries adjustable strap means, said strap means attached to the body portion of each said base and designed to provide secure attachment around and removal from a user's thigh or leg, whereby said base is also secured in place.

3. The device of claim 2 wherein said adjustable strap means includes Velcro-like loop and hook material.

4. The device of claim 1 wherein said weight securing means for each support base includes a plurality of pockets into which weights may be inserted and secured.

5. The device of claim 4 wherein weights are included in said pockets and wherein said weights are in the form of flexible bags filled with particulate or fluid weight material.

6. The device of claim 1 wherein said adjustable belt attachment means includes Velcro-like loop and hook material.

* * * * *